US007244114B2

(12) United States Patent
Hiwata et al.

(10) Patent No.: US 7,244,114 B2
(45) Date of Patent: Jul. 17, 2007

(54) SCROLL COMPRESSOR

(75) Inventors: Akira Hiwata, Kyoto (JP); Kiyoshi Sawai, Shiga (JP); Takashi Morimoto, Kyoto (JP); Yoshiyuki Futagami, Shiga (JP); Tsutomu Tsujimoto, Shiga (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 57 days.

(21) Appl. No.: 10/542,614

(22) PCT Filed: Oct. 14, 2004

(86) PCT No.: PCT/JP2004/015572

§ 371 (c)(1),
(2), (4) Date: Jul. 18, 2005

(87) PCT Pub. No.: WO2005/038256

PCT Pub. Date: Apr. 28, 2005

(65) Prior Publication Data

US 2006/0115371 A1 Jun. 1, 2006

(30) Foreign Application Priority Data

Oct. 17, 2003 (JP) ..... 2003-357702

(51) Int. Cl.
*F03C 2/00* (2006.01)
*F04C 18/00* (2006.01)

(52) U.S. Cl. ..... 418/55.2; 418/150

(58) Field of Classification Search ..... 418/55.1–55.6, 418/57, 150

See application file for complete search history.

(56) References Cited

U.S. PATENT DOCUMENTS 4,627,800 A * 12/1986 Matsudaira et al. ..... 418/55.2
6,244,840 B1 * 6/2001 Takeuchi et al. ..... 418/55.2
6,478,557 B2 * 11/2002 Shiibayashi et al. ..... 418/55.2

FOREIGN PATENT DOCUMENTS

| | | | |
|---|---|---|---|
| JP | 60-98186 | | 6/1985 |
| JP | 4-124483 | | 4/1992 |
| JP | 10-213084 | | 8/1998 |
| JP | 2000283065 | A * | 10/2000 |
| JP | 2000329079 | A * | 11/2000 |
| JP | 2002-81387 | | 3/2002 |
| JP | 2002-364562 | | 12/2002 |

* cited by examiner

*Primary Examiner*—Theresa Trieu
(74) *Attorney, Agent, or Firm*—Armstrong, Kratz, Quintos, Hanson & Brooks, LLP

(57) ABSTRACT

In a scroll compressor, an outer wall curve of a scroll lap of a fixed scroll and an inner wall curve of a scroll lap of an orbiting scroll are formed of involute curves whose basic circle radius is defined as "a", an inner wall curve of the scroll lap of the fixed scroll and an outer wall curve of the scroll lap of the orbiting scroll are formed of involute curves whose basic circle radius is defined as "b", and a value of a/b which is a ratio of the basic circle radius a and the basic circle radius b is set to a value exceeding 1.0 and less than 1.5. With this structure, a compression chamber formed on the side of the inner wall of the scroll lap of the orbiting scroll is compressed faster than a compression chamber formed on the side of the outer wall of the scroll lap of the orbiting scroll, and leakage loss during compression process can be reduced.

14 Claims, 4 Drawing Sheets

(1) When centers of basic circles are the same (2) When centers of basic circles are separated from each other.

Plan view showing scroll body shape

PRIOR ART

SCROLL COMPRESSOR

BACKGROUND OF THE INVENTION

1. Field of the Invention

The present invention relates to a scroll compressor in which a fixed scroll and an orbiting scroll whose scroll laps rise from an end plate are meshed with each other to form a compression chamber therebetween, and when the orbiting scroll is turned along a circular orbit while restraining rotation by a rotation-restricting mechanism, the compression chamber moves while changing its volume, thereby carrying out suction, compression and discharge operations.

2. Description of the Related Art

In conventional scroll compressors of this type, both scroll laps forming a fixed scroll and an orbiting scroll are formed of involute curves which are involutes of a circle having a constant radius in many cases.

In some scroll compressors, thicknesses of portions or entire scroll laps of the fixed scroll and orbiting scroll are varied from centers of the scrolls toward the outer sides (see patent document 1 for example).

In some scroll compressors, a position of an orbiting scroll having asymmetric lap shape which is wound by one turn from outside of a scroll groove is increased in height by one step to form a stepped groove, a center of cylinder enters the stepped groove from an end plate surface, the scroll compressor is provided with a turning bearing having an axis in a region which is set from the groove step wall surface and the center of the scroll shape, a fixed lap of the fixed scroll also comprises a stepped lap so that it meshes with the stepped groove and a compression chamber can be formed (see patent document 2 for example).

FIG. 6 shows a conventional scroll compressor described in patent document 1. As shown in FIG. 6, in a scroll fluid machine in which one of scroll members allows the other scroll member to turn, thereby expanding or compressing fluid, the thickness of a portion or entire shape of a scroll body 22*b* of a scroll member 22 is increased or reduced from its center toward the outer side.

(Patent Document 1)

Japanese Patent Application Laid-open No.H11-264387

(Patent Document 2)

Japanese Patent Application Laid-open No.2000-329079

However, in the case of the conventional structure in which both the scroll laps forming the fixed scroll and the orbiting scroll are formed of involute curves which are involutes of a circle having a constant radius, if a basic circle radius a, an involute angle (the number of windings) of the scroll, thickness t and height h of the scroll lap are determined, a degree of freedom with respect to the scroll shape is limited and a stroke volume and an incorporating volume ratio are determined uniquely and thus, the conventional structure has the following problems.

That is, in the case of a compressor for freezing which is operated under a condition in which a ratio between a suction pressure and a discharge pressure is great, the incorporating volume ratio must be great. In order to increase the incorporating volume ratio, however, the involute angle (the number of windings) must be increased and as a result, the outside shape is increased. If the involute angle (the number of windings) is increased while keeping the outside shape size and the height of the scroll lap are set constant, there is a problem that the thickness of the scroll lap is reduced, the strength is deteriorated, or the stroke volume is reduced.

As a known example in which the degree of freedom in design of incorporating compression ratio, the stroke volume, the thickness of the scroll lap is enhanced, there is one described in patent document 1. In this known example, thicknesses of portions or entire scroll laps of the fixed scroll and orbiting scroll are varied from centers of the scrolls toward outer sides. Therefore, the incorporating volume ratio is secured while reducing the outside shape, and the strength of the center is secured.

On the other hand, if the scroll lap of the fixed scroll is formed into an asymmetric lap shape in which the scroll lap is expanded to a winding end of the scroll lap of the orbiting scroll, the stroke volume can be increased and thus, the height of the scroll lap or the outer shape size can be reduced. The compression chamber formed on the side of an outer wall of the scroll lap of the orbiting scroll can minimize the heat-reception loss and the pressure loss in a suction process for enclosing working fluid. Therefore, the scroll compressor can be made compact, and the loss of working fluid in the suction process can be reduced.

However, working fluid in the compression chamber formed on the side of the outer wall of the scroll lap of the orbiting scroll and working fluid in the compression chamber formed on the side of the inner wall of the scroll lap of the orbiting scroll are compressed in a state in which a difference between both the working fluids is maintained. Thus, there is a problem that leakage loss between the compression chambers is generated during the compressing process.

In patent document 1, there is no concrete explanation concerning the idea for reducing the leakage loss during the compression process in terms of the asymmetric lap shape.

Concerning the asymmetric lap shape, to reduce the leakage loss during the compression process, patent document 2 provides a known compact scroll compressor having high efficiency. In this known example, the lap is formed into a staircase shape. With this, the leakage loss during compression can be reduced although the lap is asymmetric in shape.

However, because the lap is formed into the staircase shape, there is a problem that it is difficult to secure sealing properties between the laps of the staircase portions, the number of producing processes is increase, and cost thereof is increased.

The present invention has been accomplished to solve the above conventional problems, and it is an object of the invention to provide a compact and simple scroll compressor which can reduce a leakage loss during compression process of an asymmetric lap shape.

SUMMARY OF THE INVENTION

A first aspect of the present invention provides a scroll compressor in which a fixed scroll and an orbiting scroll whose scroll laps rise from an end plate are meshed with each other to form a compression chamber therebetween, and when the orbiting scroll is turned along a circular orbit while restraining rotation by a rotation-restricting mechanism, the compression chamber moves while changing its volume, thereby carrying out suction, compression and discharge operations, wherein an outer wall curve of a scroll lap of the fixed scroll and an inner wall curve of a scroll lap of the orbiting scroll are formed of involute curves whose basic circle radius is defined as "a", an inner wall curve of the scroll lap of the fixed scroll and an outer wall curve of the scroll lap of the orbiting scroll are formed of involute curves whose basic circle radius is defined as "b", and a value of a/b which is a ratio of the basic circle radius a and the basic circle radius b is set to a value exceeding 1.0 and less than 1.5.

According to this aspect, because the value a/b exceeds 1.0, a compression chamber formed on the side of the inner wall of the scroll lap of the orbiting scroll is compressed faster than a compression chamber formed on the side of the outer wall of the scroll lap of the orbiting scroll, and leakage loss during compression process can be reduced. Because the value a/b is less than 1.5, thicknesses of both the scroll laps do become extremely thin and thus, the strength of the scroll lap can be secured.

According to a second aspect of the invention, in the scroll compressor of the first aspect, an involute angle θa at which an inner wall curve of the scroll lap of the fixed scroll is terminated and an involute angle θb at which an inner wall curve of the scroll lap of the orbiting scroll is terminated satisfy a relation of $\theta b<\theta a<\theta b+\pi$.

According to this aspect, it is possible to optimally design the scroll compressor while taking into consideration a balance between the influence of a heat-reception loss in the suction process and a leakage loss between the compression chambers in the compression process.

According to a third aspect of the invention, in the scroll compressor of the first or second aspect, a center position of the basic circle radius a and a center position of the basic circle radius b are aligned with each other.

According to this aspect, since the number of producing processes of the scroll lap working operation can be reduced, the leakage loss during the compression process can be reduced, and the producing cost can be reduced.

According to a fourth aspect of the invention, in the scroll compressor of the first or second aspect, a center position of the basic circle radius a and a center position of the basic circle radius b are separated from each other.

According to this aspect, the compression chamber formed on the side of the inner wall of the scroll lap of the orbiting scroll is compressed faster than the compression chamber formed on the side of the outer wall of the scroll lap of the orbiting scroll, leakage loss can be reduced, and the thickness of the scroll lap of the scroll can be changed. Thus, the strength of the scroll lap can be adjusted freely.

A fifth aspect of the invention provides a scroll compressor in which a fixed scroll and an orbiting scroll whose scroll laps rise from an end plate are meshed with each other to form a compression chamber therebetween, and when the orbiting scroll is turned along a circular orbit while restraining rotation by a rotation-restricting mechanism, the compression chamber moves while changing its volume, thereby carrying out suction, compression and discharge operations, wherein a thickness of a scroll lap of the fixed scroll is increased from its center toward an outer side thereof, and a thickness of a scroll lap of the orbiting scroll is reduced from its center toward an outer side thereof.

According to this aspect, the compression chamber formed on the side of the inner wall of the scroll lap of the orbiting scroll is compressed faster than the compression chamber formed on the side of the outer wall of the scroll lap of the orbiting scroll, and leakage loss during compression process can be reduced.

According to a sixth aspect of the invention, in the scroll compressor of any one of the first to fifth aspects, a refrigerant is a high pressure refrigerant, e.g., carbon dioxide.

With this aspect, a pressure deformation is reduced, galling or abnormal wear can effectively be prevented, and the leakage loss between the compression chambers can effectively be reduced.

DETAILED DESCRIPTION OF EXEMPLARY EMBODIMENTS

First Embodiment

Embodiments of the present invention will be explained below with reference to the drawings. The invention is not limited by the embodiments.

Figure 1:
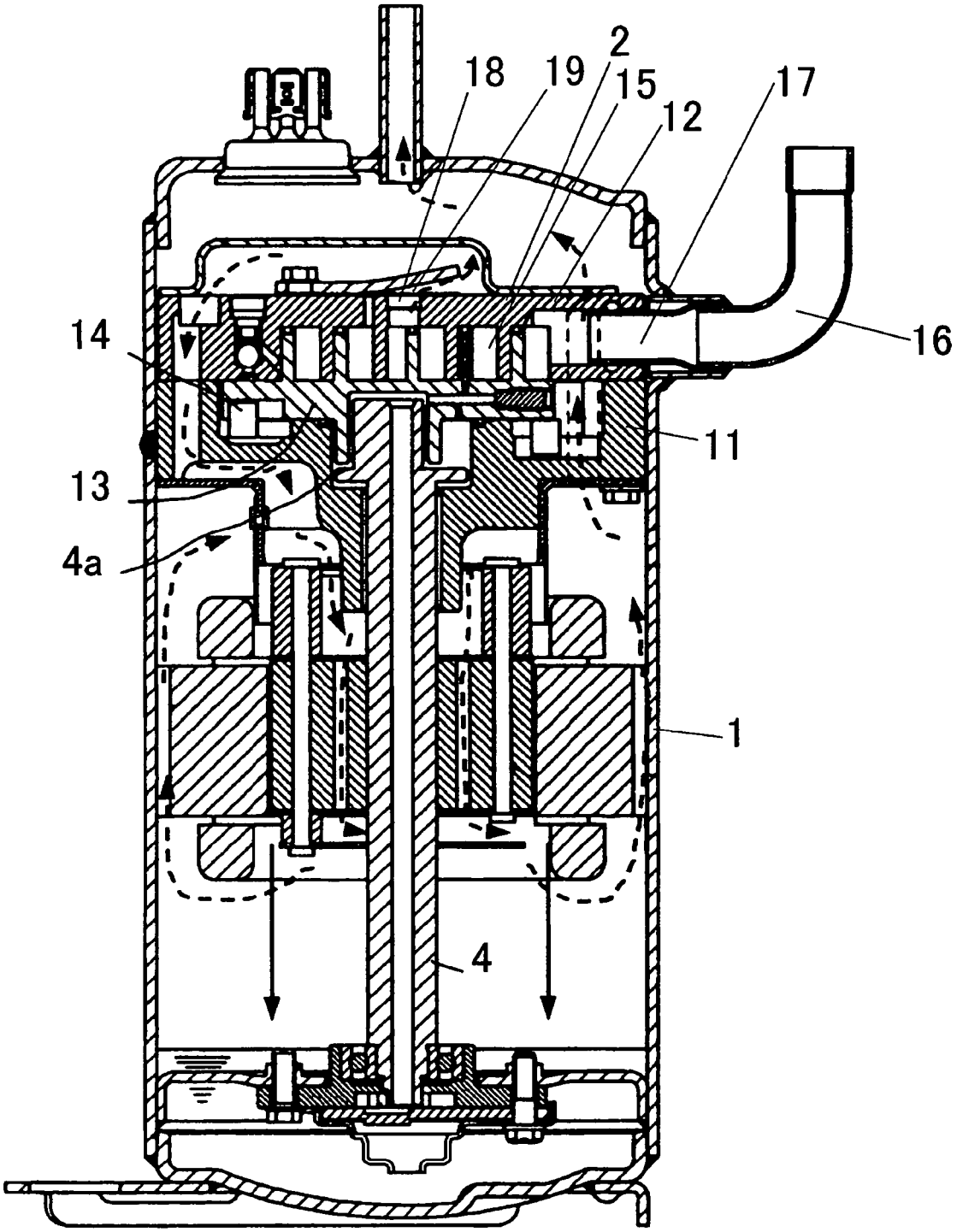
FIG. 1 is a sectional view of a scroll compressor of a first embodiment of the present invention.

FIG. 1 is a sectional view of a scroll compressor of a first embodiment of the invention. An orbiting scroll 13 which meshes with a fixed scroll 12 is sandwiched between a main bearing member 11 of a crankshaft 4 which is fixed in a container 1 by means of welding or shrinkage fit and the fixed scroll 12 which is bolted to the main bearing member 11, thereby constituting a scroll compression mechanism 2. A rotation-restricting mechanism 14 such as an Oldham ring is provided between the orbiting scroll 13 and the main bearing member 11. The rotation-restricting mechanism 14 guides the orbiting scroll 13 such that rotation of the orbiting scroll 13 is prevented and is allowed to move in a circular orbit. The orbiting scroll 13 is eccentrically driven by a main shaft portion 4*a* on an upper end of the crankshaft 4, thereby allowing the orbiting scroll 13 to move in the circular orbit. With this, a compression chamber 15 formed between the fixed scroll 12 and the orbiting scroll 13 is reduced while moving from an outer periphery of the compression chamber 15 toward its center. Utilizing this fact, refrigerant gas is sucked from a suction pipe 16 which is in communication with outside of the container 1 and from a suction port 17 of an outer periphery of the fixed scroll 12, the refrigerant gas is compressed to increase its pressure, the refrigerant gas whose pressure becomes equal to or greater than a predetermined value pushes a reed valve 19 from a discharge port 18 of a central portion of the fixed scroll 12, and the refrigerant gas is discharged into the container 1, and the above action is repeated.

Figure 2:
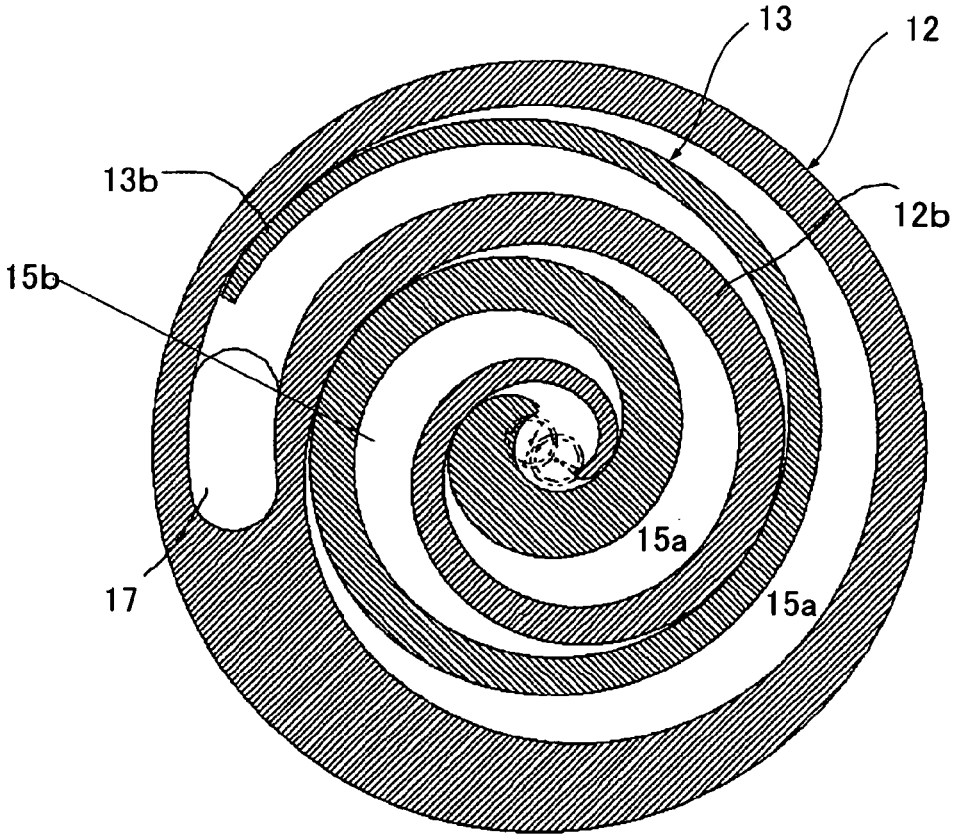
FIG. 2 is a sectional view of a compression mechanism in the scroll compressor of the embodiment.

FIG. 2 is a sectional view of a compression mechanism of the scroll compressor of the embodiment. An outer wall curve of a scroll lap 12*b* of the fixed scroll 12 and an inner wall curve of a scroll lap 13*b* of the orbiting scroll 13 are formed of involute curves whose basic circle radius is defined as "a". An inner wall curve of the scroll lap 12*b* of the fixed scroll 12 and an outer wall curve of the scroll lap 13*b* of the orbiting scroll 13 are formed of involute curves whose basic circle radius is defined as "b". A value of a/b which is a ratio of the basic circle radius a and the basic circle radius b is set to a value exceeding 1.0. With this, a compression chamber 15*b* formed on the side of the inner wall of the scroll lap 13*b* of the orbiting scroll 13 is compressed faster than a compression chamber 15*a* formed on the side of the outer wall of the scroll lap 13*b* of the orbiting scroll 13.

Figure 3:
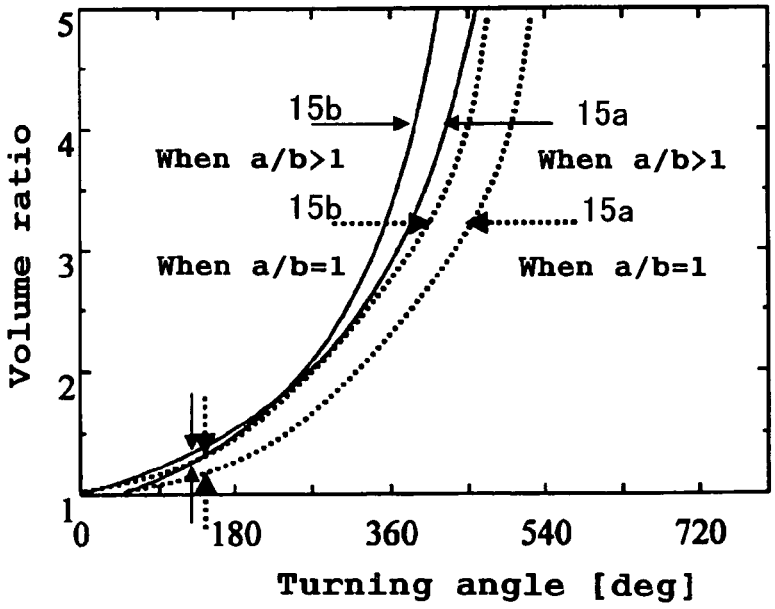
FIG. 3 is a diagram showing a volume variation of a compression chamber with respect to a turning angle in the scroll compressor of the embodiment.

FIG. 3 is a diagram showing a volume variation of the compression chamber with respect to a turning angle (rotation angle of the crankshaft 4) in the scroll compressor of the embodiment. Solid lines show the volume variation of the scroll compressor of the embodiment (a/b>1.0), and dotted lines shows volume variation of a conventional asymmetric scroll compressor (a/b=1.0). In FIG. 3, a difference in volume ratio between the compression chamber 15*b* and the compression chamber 15*a* when the turning angles are the same is proportional to a pressure difference between the compression chamber 15*b* and the compression chamber 15*a*. That is, as the volume ratio difference when the turning angles are the same is smaller, the leakage in the compression chamber 15 is smaller. If the conventional asymmetric scroll compressor is compared with the present invention, the volume ratio is smaller, and it can be found that the leakage in the compression chamber 15 is smaller.

However, if the value a/b which is the ratio of the basic circle radius a and the basic circle radius b is set to 1.5 or greater, the variation in thickness of both the scroll laps becomes extremely large, thickness of the winding-end portion of the scroll lap 13*b* of the orbiting scroll 13 and thickness of the winding-start portion of the scroll lap 12*b* of the fixed scroll 12 become excessively thin and thus, strength thereof is deteriorated. To secure the reliability of the compressor, it is necessary that the value a/b is less than 1.5.

As described above, in the scroll compressor of the embodiment, the outer wall curve of the scroll lap 12*b* of the fixed scroll 12 and the inner wall curve of the scroll lap 13*b* of the orbiting scroll 13 are formed of the involute curves whose basic circle radius is defined as "a". The inner wall curve of the scroll lap 12*b* of the fixed scroll 12 and the outer wall curve of the scroll lap 13*b* of the orbiting scroll 13 are formed of the involute curves whose basic circle radius is defined as "b". The value of a/b which is the ratio of the basic circle radius a and the basic circle radius b is set to the value exceeding 1.0. With this, the compression chamber 15*b* formed on the side of the inner wall of the scroll lap 13*b* of the orbiting scroll 13 is compressed faster than the compression chamber 15*a* formed on the side of the outer wall of the scroll lap 13*b* of the orbiting scroll 13, and the leakage loss during the compression process can be reduced.

If the value a/b is set to less than 1.5, since the thicknesses of both the scroll laps do not become excessively thin, it is possible to secure the strength of the scroll laps.

In the scroll compressor of the embodiment, a center position of the basic circle radius b and a center position of the basic circle radius b are aligned with each other. With this structure, the number of producing processes of the scroll lap working operation can be reduced. Therefore, the leakage loss during the compression process can be reduced, and the costs of the production can be reduced.

Alternatively, it is also possible to constitute the scroll compressor such that the thickness of the scroll lap 12*b* of the fixed scroll 12 is increased from its center toward the outer side, and the thickness of the scroll lap 13*b* of the orbiting scroll 13 is reduced from its center toward the outer side (not shown). With this structure also, like this embodiment, the compression chamber 15*b* formed on the side of the inner wall of the scroll lap 13*b* of the orbiting scroll 13 is compressed faster than the compression chamber 15*a* formed on the side of the outer wall of the scroll lap 13*b* of the orbiting scroll 13, and the leakage loss during the compression process can be reduced.

In the above-described scroll compressors, the curve constituting the scroll lap thereof is not limited to the involute curve, and the curve may be Archimedean curve, involute curve whose radius is varied depending upon the involute angle of a circle, and the like.

Second Embodiment

Figure 4:
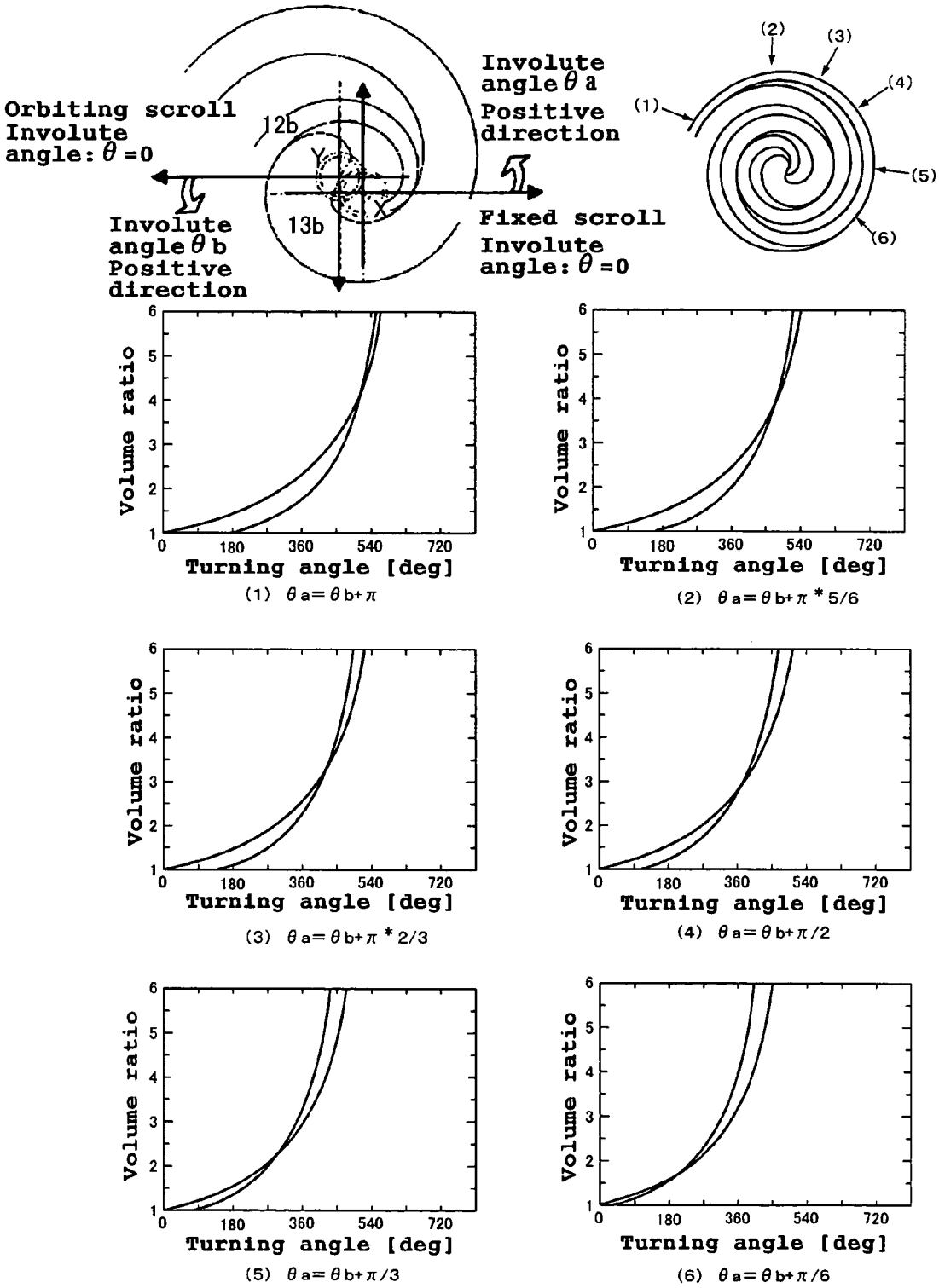
FIG. 4 are diagrams showing a volume variation of a compression chamber with respect to a turning angle when an involute angle θa of the scroll compressor of a second embodiment of the invention is varied in a range of $\theta b<\theta a<\theta b+\pi$.

FIG. 4 include diagrams showing a volume variation of a compression chamber with respect to a turning angle when an involute angle θa of the scroll compressor of a second embodiment of the invention is varied in a range of $\theta b<\theta a<\theta b+\pi$. FIG. 4 shows variation in volume of the compression chamber 15 with respect to a rotation angle (turning angle) of the crankshaft 4 when the involute angle θa at which the inner wall curve of the scroll lap 12*b* of the fixed scroll 12 is terminated, and an involute angle θb at which the inner wall curve of the scroll lap 13*b* of the orbiting scroll 13 is terminated are varied in the range of $\theta b<\theta a<\theta b+\upsilon\pi$.

Here, a coordinate system X in which a basic circle center of the inner wall curve of the scroll lap 12*b* of the fixed scroll 12 is defined as an origin point is provided, and an arbitrary direction is defined as an involute angle: θ=0. A direction which is turned in the counterclockwise direction from the former direction is defined as a positive direction of the involute angle. Further, a coordinate system Y in which a basic circle center of the outer wall curve of the scroll lap 13*b* of the orbiting scroll 13 is defined as an origin point is provided. The coordinate system Y is equal to a coordinate system obtained by rotating the coordinate system X through 180°. In the following description, the involute angle in this embodiment shows an angle as measured based on the coordinate system X in the case of a curve of the scroll lap 12*b* of the fixed scroll 12, and shows an angle as measured based on the coordinate system Y in the case of a curve of the scroll lap 13*b* of the orbiting scroll 13.

As can be seen from FIG. 4, it is possible to reduce the difference in volume ratio with the same turning angle even if the involute angle θb is varied. That is, it is possible to optimally design the scroll compressor while taking into consideration a balance between the influence of a heat-reception loss in the suction process and a slippage loss of the compression chamber 15 in the compression process in addition to characteristics of working fluid (refrigerant). For example, if a refrigerant has high density and large pressure difference, it can be conceived that the influence of slippage loss between the compression chambers in the compression process is greater than that of the heat-reception loss in the suction process. Therefore, it is possible to employ a structure in which the involute angle θa is brought closer to the involute angle θb. If a refrigerant has low density and small pressure difference, it is possible to employ a structure in which the involute angle θa is brought closer to the involute angle $\theta b+\pi$ on the contrary.

Third Embodiment

Figure 5:
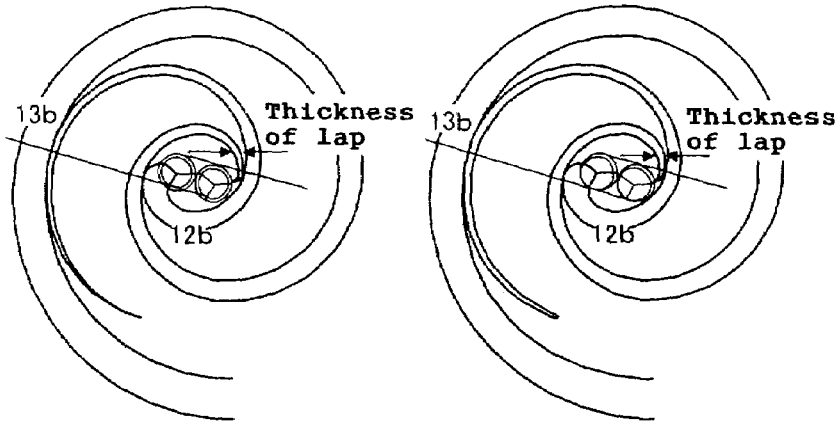
FIG. 5 are plan views showing a scroll lap shape of a scroll compressor of a third embodiment of the invention.
Figure 6:
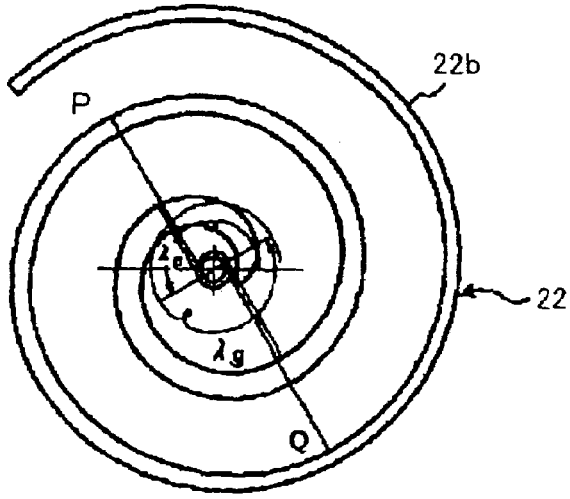
FIG. 6 is a plan view showing a scroll body shape of a conventional scroll compressor.

FIG. 5 shows plan views showing a scroll lap shape of a scroll compressor of a third embodiment of the invention. In FIG. 5, the center position of the basic circle radius a and the center position of the basic circle radius b are separated from each other. With this, the compression chamber 15*b* formed on the side of the inner wall of the scroll lap 13*b* of the orbiting scroll 13 is compressed faster than the compression chamber 15*a* formed on the side of the outer wall of the scroll lap 13*b* of the orbiting scroll 13, and while keeping this characteristic, the thickness of the scroll lap can be varied. Therefore, the strength of the scroll lap can be adjusted freely.

Fourth Embodiment

In a scroll compressor of a fourth embodiment of the present invention, the refrigerant is a high pressure refrigerant, e.g., a carbon dioxide refrigerant (not shown). The high pressure refrigerant has large pressure difference between the compression chambers 15 in the compression process. Thus, the slippage loss can be reduced more effectively. In the case of the high pressure refrigerant, the orbiting scroll 13 is largely deformed due to the pressure difference, and galling or abnormal wear is caused, but in the scroll compressor of this embodiment, since the thickness of a center portion of the scroll lap 13*b* of the orbiting scroll 13 can be increased, it is possible to suppress the pressure deformation, and to effectively prevent the galling and abnormal wear.

The scroll compressor having asymmetric laps has a compact and simple structure, and the leakage loss during the compression process can be reduced.

INDUSTRIAL APPLICABILITY

As described above, according to the scroll compressor of the present invention, since the leakage loss during the compression process can be reduced, and the scroll compressor can be made compact, working fluid is not limited to refrigerant, and the present invention can be applied to a scroll fluid machine such as an air scroll compressor, an oil-free compressor and a scroll expander.

The invention claimed is:

1. A scroll compressor in which a fixed scroll and an orbiting scroll whose scroll laps rise from an end plate are meshed with each other to form a compression chamber therebetween, and when said orbiting scroll is turned along a circular orbit while restraining rotation by a rotation-restricting mechanism, said compression chamber moves while changing its volume, thereby carrying out suction, compression and discharge operations, wherein an outer wall curve of a scroll lap of said fixed scroll and an inner wall curve of a scroll lap of said orbiting scroll are formed of involute curves whose basic circle radius is defined as "a", an inner wall curve of said scroll lap of said fixed scroll and an outer wall curve of said scroll lap of said orbiting scroll are formed of involute curves whose basic circle radius is defined as "b", and a value of a/b which is a ratio of said basic circle radius a and said basic circle radius b is set to a value exceeding 1.0 and less than 1.5.

2. The scroll compressor according to claim 1, wherein an involute angle θa at which an inner wall curve of said scroll lap of said fixed scroll is terminated and an involute angle θb at which an inner wall curve of said scroll lap of said orbiting scroll is terminated satisfy a relation of $\theta b<\theta a<\theta b+\pi$.

3. The scroll compressor according to claim 2, wherein a center position of said basic circle radius a and a center position of said basic circle radius b are aligned with each other.

4. The scroll compressor according to claim 3, wherein a refrigerant is a high pressure refrigerant.

5. The scroll compressor according to claim 4, wherein the refrigerant is carbon dioxide.

6. The scroll compressor according to claim 2, wherein a center position of said basic circle radius a and a center position of said basic circle radius b are separated from each other.

7. The scroll compressor according to claim 6, wherein a refrigerant is a high pressure refrigerant.

8. The scroll compressor according to claim 7, wherein the refrigerant is carbon dioxide.

9. The scroll compressor according to claim 2, wherein a refrigerant is a high pressure refrigerant.

10. The scroll compressor according to claim 9, wherein the refrigerant is carbon dioxide.

11. The scroll compressor according to claim 1, wherein a refrigerant is a high pressure refrigerant.

12. The scroll compressor according to claim 11, wherein the refrigerant is carbon dioxide.

13. The scroll compressor according to claim 1, wherein a center position of said basic circle radius a and a center position of said basic circle radius b are aligned with each other.

14. The scroll compressor according to claim 1, wherein a center position of said basic circle radius a and a center position of said basic circle radius b are separated from each other.

* * * * *